US006345780B1

(12) United States Patent
Poloni et al.

(10) Patent No.: US 6,345,780 B1
(45) Date of Patent: Feb. 12, 2002

(54) COIL FORMING HEAD

(75) Inventors: Alfredo Poloni, Fogliano di Redipuglia; Andrea De Luca, Remanzacco; Miroslav Zerajic, Palmanova; Fausto De Marco, Remanzacco, all of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/484,416

(22) Filed: Jan. 18, 2000

(30) Foreign Application Priority Data

Jan. 26, 1999 (IT) ..... UD99A0018

(51) Int. Cl.[7] ..... B12C 47/10
(52) U.S. Cl. ..... 242/361.3
(58) Field of Search ..... 242/361, 361.3, 242/361.1, 361.4, 361.5

(56) References Cited

U.S. PATENT DOCUMENTS

| | | | | | |
|---|---|---|---|---|---|
| 501,251 | A | * | 7/1893 | Kilmer | |
| 3,490,500 | A | * | 1/1970 | Dopper et al. | 140/1 |
| 3,563,488 | A | | 2/1971 | Bollig | 242/82 |
| 3,843,072 | A | * | 10/1974 | Rayfield | 242/82 |
| 4,153,212 | A | * | 5/1979 | Bauch et al. | 242/47 |
| 4,765,556 | A | * | 8/1988 | Nasrah | 242/82 |
| 5,312,065 | A | | 5/1994 | Shore et al. | 242/82 |
| 5,934,594 | A | * | 8/1999 | David | 242/361 |
| 6,149,091 | A | * | 11/2000 | Poloni et al. | 242/361.4 |

FOREIGN PATENT DOCUMENTS

| | | |
|---|---|---|
| DE | 1925800 | 11/1970 |
| DE | 3347031 | 11/1984 |
| EP | 0554976 | 8/1993 |

* cited by examiner

*Primary Examiner*—Donald P. Walsh
*Assistant Examiner*—Mark J. Beauchaine
(74) *Attorney, Agent, or Firm*—Stevens, Davis, Miller & Mosher, LLP

(57) ABSTRACT

Coil-forming head to form coils starting from continuous and substantially rectilinear rolled stock, of the type comprising a mandrel rotating around a substantially horizontal axis, containing inside itself a shaped tube conformed as a spiral inside which the rolled stock is introduced, there being included, in cooperation with the outlet end section of said shaped tube, a ring-shaped containing element arranged outside said shaped tube and including at least a segment of inner wall which tapers and diverges towards the outside suitable to allow a controlled expansion of the trailing-end segment of the rolled stock.

15 Claims, 2 Drawing Sheets

COIL FORMING HEAD

FIELD OF THE INVENTION

This invention concerns a coil-forming head as set forth in the main claim.

The coil-forming head according to the invention is applied in machines to form coils starting from continuous and substantially rectilinear semi-worked pieces arriving from the rolling mill or from another similar source, such as for example rods, round pieces or similar.

BACKGROUND OF THE INVENTION

In the state of the art, coiling machines consist of a rotary coil-forming head comprising a tube, terminally shaped as a spiral, with an inlet axis coaxial to the rolling axis, substantially horizontal, and the outlet axis tangent to the nominal theoretical diameter of the coils which are to be obtained.

The rolled stock leaving the finishing stand is sent inside the shaped tube which bends to form at outlet a succession of coils with a defined pitch and diameter. The coils formed in this way fall and are deposited onto a roller-way to be cooled and sent to the collection and/or stacking zone.

The shaped tube is made to rotate around the rolling axis by suitable motor means at a velocity such that the outlet section, tangent to the nominal diameter of the coils to be obtained, has a peripheral velocity substantially equal to the rolling speed.

In this way, the kinetic energy possessed by the rolled stock entering the shaped tube can be completely discharged inside the said tube and the coils emerge substantially stationary with respect to an outside observer.

The kinetic energy possessed by the rolled stock is mainly balanced, inside the shaped tube, by the friction generated between the rolled stock and the inner walls of the tube due to the components of force normal to the direction of movement to which the rolled stock is subjected.

Apart from this, a part of the kinetic energy is balanced by a state of traction which is determined upstream of the coil-forming head; said traction is balanced since the trailing end of the rolled stock is held between the rollers of the finishing stand.

When the trailing end of the rod exits from the finishing stand, the balance of the traction forces continues to be ensured due to the presence of a drawing assembly located upstream of the coil-forming head, the function of which is substantially to brake and control the trailing end of the rolled stock.

But when the trailing end leaves the drawing assembly too, an unbalance is created in the forces, since the traction on the rolled stock generated by the coil-forming head is no longer balanced by an equal and contrary force acting upstream of the head.

This unbalance in the forces causes a violent acceleration of the trailing end which is translated into an increased velocity of the material compared with the peripheral velocity of the shaped tube.

If not controlled, this increased velocity would tend to cause the formation of one or more trailing-end coils with a much larger diameter than the desired nominal diameter.

To overcome this shortcoming, the state of the art provides, at the outlet of the shaped tube, a stationary cylindrical ring with a diameter slightly more than the nominal diameter of the coils, the function of which is to prevent the formation of trailing-end coils with a diameter much greater than the nominal diameter.

An example of this embodiment is shown in U.S. Pat. No. 3,563,488.

The trailing-end segment, therefore, which would tend to form coils of a greater diameter, stops against the ring, and vents the energy deriving from the impact by bending the round piece.

In this way, an omega shaped bend, or loop, is formed in the trailing-end segment of the rolled stock, located on the last coil.

The formation of this loop is extremely undesirable since it causes problems of blockages in the collection and stacking operations; it is therefore necessary to provide manually to at least partly straighten the loop in order to limit such problems to a minimum. Moreover, the loop must necessarily be eliminated manually before the finished reels are tied.

All this entails an undesirable increase in the work force, and also a waste of material.

Various solutions have been proposed to overcome this disadvantage which businessmen in this field have long been complaining about.

One solution—to instantaneously conform the velocity of the coil-forming tube to that of the trailing end of the rolled stock—has been discarded because it is not feasible, due to the minimum times available to modify the velocity of rotation of the tube and the high inertias in play.

U.S. Pat. No. 5,312,065 shows a coil-forming head comprising a shaped tube of a conventional type associated at outlet with a guide extension consisting of an inner element which rotates with the tube, and of an outer element, which can be fixed or can rotate independently of the tube.

The inner rotary element is spiral shaped and has an open inlet end facing the outlet end of the coil-forming tube.

The function of the inner element is substantially to prolong the guiding action of the coil-forming tube, allowing the efficient formation of a circular trailing-end coil and preventing the formation of loops or hooks.

The inner element is removable, and can be removed in the case of low speed rolling of large diameter product, wherein the function of supplementary guide is not necessary but even harmful.

The outer element consists of a cylindrical screen of a greater diameter than the nominal diameter of the coils; its function is to absorb, through sliding friction, the excess energy possessed by the rolled stock when its trailing end leaves the drawing assembly located upstream of the coil-forming head.

This embodiment is valid in theory, but in practice it has shown itself to be unusable on an industrial scale because it is complex and unreliable, particularly in the case of a high velocity rotary coil-forming head.

Another solution could be to completely eliminate the containing ring, or to make it with a much larger diameter than the terminal diameter of the coil-forming tube, which would allow the trailing-end coil to reach its natural diameter according to the increased velocity acquired.

However, this cannot be achieved for various reasons, including the connected problems of safety for the workers, or the so-called "chewing" of the coils caused by the passage of the spiral-shaped terminal end of the coil-forming head over the material which has already been expelled from the tube and is blocked against the ring.

Document DE-A-19 25 800 describes a device to produce reels of rod comprising a guide tube with a vertical axis and equipped with both rotation movement around the vertical axis and also oscillatory movement along the same axis.

Due to the positioning on the vertical axis of the rod guide tube, there are very different problems to be faced compared with coil-forming tubes having a horizontal axis similar to that of the Applicant's invention, since the problems connected with the increased velocity of the trailing end of the rolled stock are radically different, especially because, in the case of DE'800, the rod enters the tube after having been bent and therefore considerably slowed down.

At outlet from said vertical axis guide tube there is a conical impact hood: as the oscillatory movement of the guide tube along its axis continually varies the reciprocal position of the outlet tube and the conical hood, it allows to continually vary and control the diameter of the coils of the reel being formed.

The device described in DE'800 substantially serves to obtain as compact a reel as possible, preventing interstices from forming and optimising the use of the coiling spaces available.

The impact hood, consisting of segments which can be radially adjusted, is always involved in the process of forming the coils, and not only in the final stage of forming the coils when the trailing end of the rolled stock is subjected to increased velocity.

The present Applicant has devised and embodied this invention to overcome this shortcoming, connected to the increased velocity of the trailing end of a rolled product emerging from a horizontal-axis coil-forming tube, with a simple but extremely efficacious solution.

SUMMARY OF THE INVENTION

The invention is set forth and characterised in the main claim while the dependent claims describe other characteristics of the main embodiment.

The purpose of the invention is to achieve a coil-forming head, of the type rotating around a substantially horizontal and longitudinally fixed axis, suitable to improve the conformation of the trailing-end coils, eliminating the problems caused by the increased velocity assumed by the trailing-end segment at the moment when it leaves the drawing devices.

To be more exact, the purpose of the invention is to prevent the formation of the unwanted trailing-end loop, thus obtaining a terminal coil with a substantially circular conformation and therefore eliminating the need for manual straightening and cutting interventions.

A further purpose of the invention is to achieve a simple, economical solution which can be applied substantially to every pre-existing coil-forming head of the type mentioned above, and moreover particularly suitable for small diameter, very high velocity rolled stock.

According to the invention, at the outlet of the shaped tube which forms the coils, rotating around a substantially horizontal axis, there is a substantially coaxial containing ring with a tapering conformation diverging outwards.

The tapering ring is defined by a lesser diameter, facing towards the inside of the coil-forming head, and by a larger diameter, facing towards the outlet of the coil-forming head from which the formed coils are discharged.

The inclination of the taper, according to the invention, is advantageously but not restrictively between 10° and 80°.

The trailing-end coils emerging from the shaped tube, which tend to expand radially due to the increased velocity, are then induced to lie on the inclined plane of the tapering ring and can then gradually vent the kinetic energy acquired.

Therefore, the presence of the tapering ring at the outlet of the coil-forming tube allows to prevent the perpendicular impact of the material against a fixed cylindrical ring, thus preventing the blockage of the material and the consequent formation of the trailing-end loop.

At the same time, the ring ensures in any case containment and protection for the workers, allowing the material to expand gradually and vent its increased velocity, but prevents an excessive, uncontrolled expansion.

Moreover, the material progressively translates towards the outlet of the coil-forming head and hence the last coils formed are not subject to damage deriving from a subsequent passage over the material of the terminal part of the spiral shaped coil-forming head.

In a first embodiment, the containing ring is fixed.

According to a variant, the ring is made to rotate by the mandrel of the coil-forming head.

The trailing-end coils which are obtained with the solution of the invention have a slightly larger diameter than the nominal one, but in any case it is always limited within an acceptable tolerance, and they can thus slow down against the inclined surface of the tapering ring and be discharged onto the discharge belt.

According to one embodiment of the invention, downstream of the diverging tapering ring there is at least a substantially cylindrical segment, the function of which is to stabilize the trailing end coils after they have formed on said tapering ring.

BRIEF DESCRIPTION OF THE DRAWINGS

The attached Figures are given as a non-restrictive example and show some preferential embodiments of the invention wherein.

DETAILED DESCRIPTION OF PREFERRED EMBODIMENT

Figure 1:
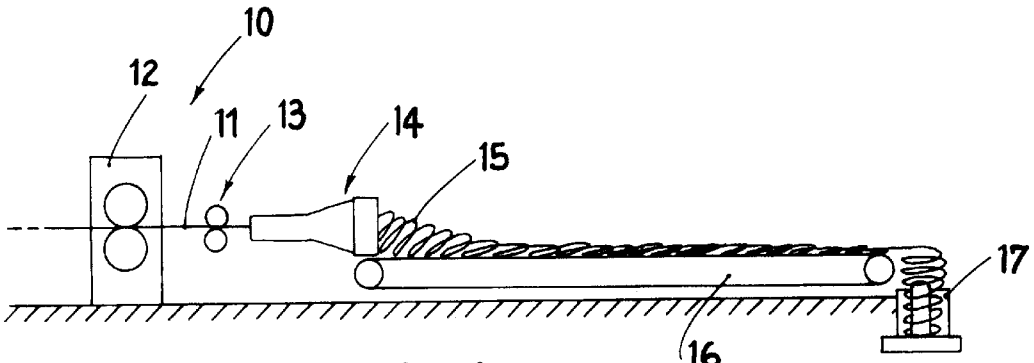
FIG. 1 is a schematic view of the terminal segment of a rolling line comprising a coil-forming head according to the invention.

The terminal segment of a rolling line 10 for long products 11, such as rods or round pieces, typically comprises a finishing stand 12, followed by a drawing assembly 13 which sends the product 11 to a rotary coil-forming head 14.

The terminal segment is only shown here in diagram form; the cooling assemblies, the drawing assemblies, the cropping shears and any other functional assemblies between the finishing stand 12 and the coil-forming head 14 are not shown here for the sake of simplicity, and because they are not important for the purposes of the invention.

The coil-forming head 14 is suitable to form a plurality of coils 15 of defined pitch and diameter and to discharge them onto a conveyor 16 which transports them towards the collection and stacking shaft 17.

The coil-forming head 14 comprises a mandrel 18 rotating around a substantially horizontal axis and substantially coinciding with the rolling axis, supported by bearing means 19 and made to rotate, by means of gears 20, by a motor 21.

It should be understood that the coil-forming head 14 as shown in the Figures is only given as an example, since it may have a partly different conformation and structure, a different type of drive, a different type of bearings, etc.

Inside the rotary mandrel 18 there is a shaped guide tube 24, terminally shaped like a spiral, inside which the rolled stock 11 is guided by means of a feed channel 22 associated upstream with an introduction element 23.

The shaped tube 24 cooperates, in a substantially terminal position, with a front plate 25 associated with the rotary mandrel 18 by means of a shaft 26 arranged in axial prosecution of the mandrel 18 itself.

The front plate 25 substantially functions as the helix of the coil-forming head 14 and supports the spiral-shaped terminal part of the shaped tube 24.

The shaped tube 24 is also supported at an intermediate position by supports 27 attached to the shaft 26 of the plate 25.

Around the terminal part of the mandrel 18, the shaft 26 and the plate 25, there is a bell element 28 with a containing and protective function.

The shaped tube 24 is made to rotate solidly with the mandrel 18 and has the function of bending the rolled stock 11 until coils 15 are obtained at outlet with a nominal diameter equal to the diameter of the front plate 25.

The velocity of rotation of the mandrel 18 is such that the outlet section of the tube 24 assumes a peripheral velocity substantially equal to the linear velocity at which the product 11 is fed, corresponding to the rolling speed.

Figure 2:
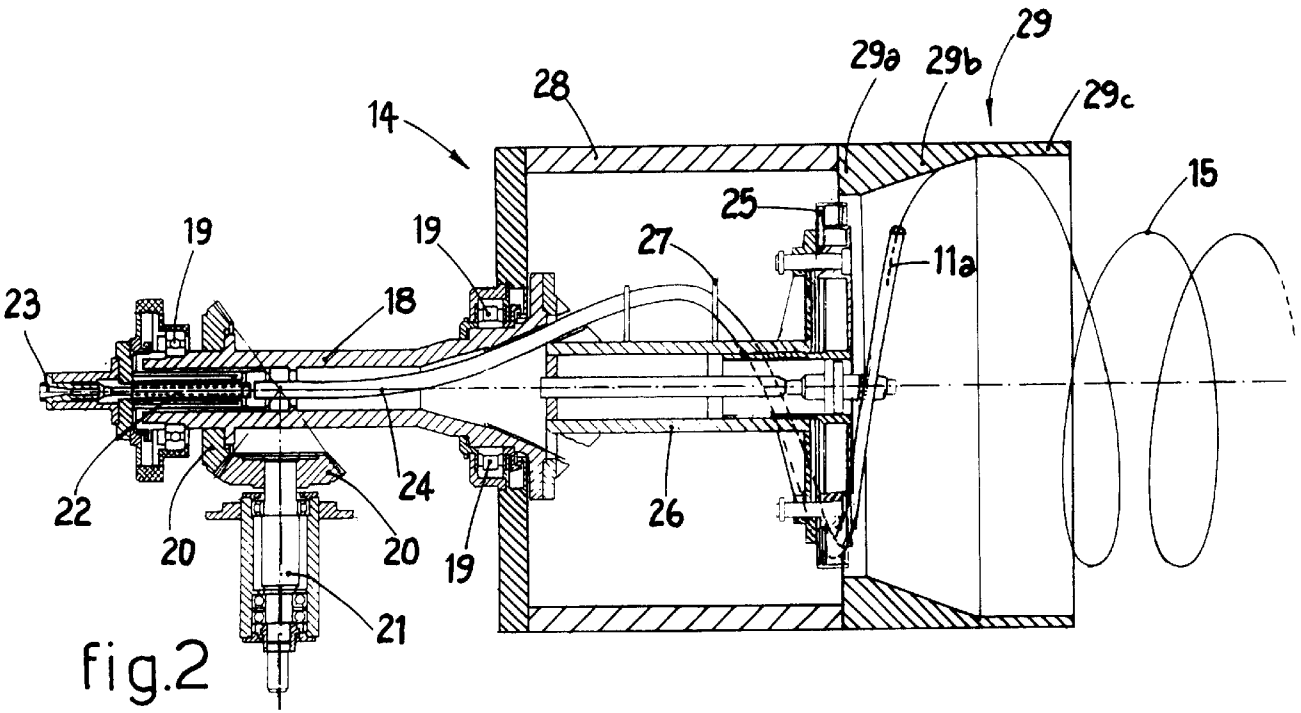
FIG. 2 shows a longitudinal section of a form of embodiment of the coil-forming head according to the invention.
Figure 3:
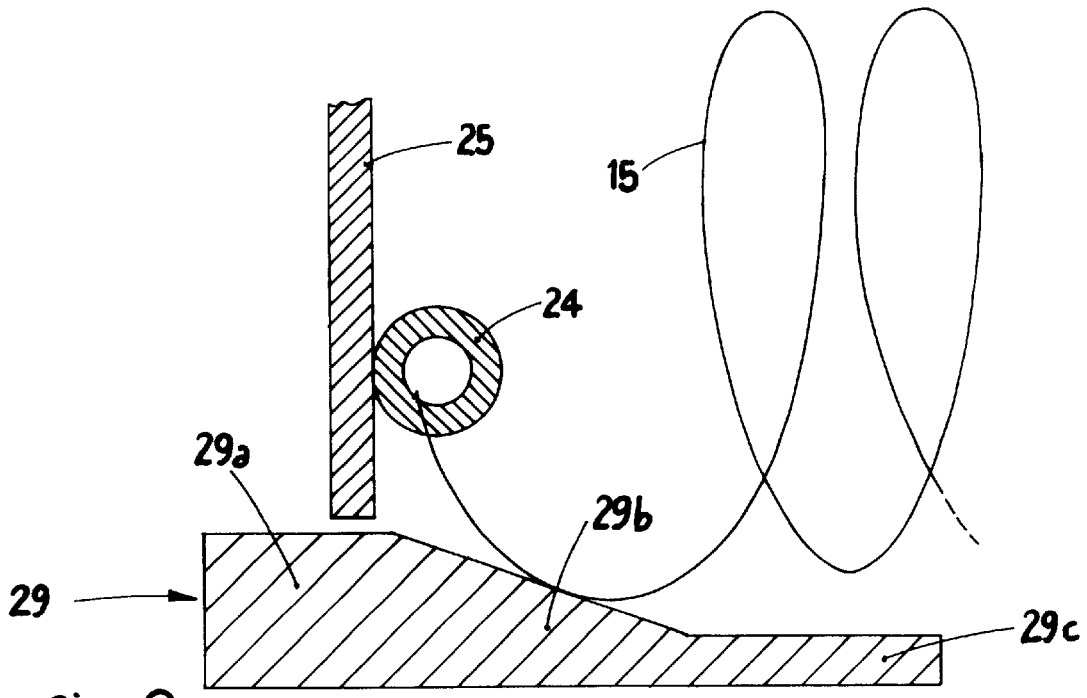
FIG. 3 shows schematically a detail of a coil-forming head achieved according to the invention.

When the end segment, or trailing end, of the rolled stock 11, indicated in FIG. 2 by the reference number 11*a*, leaves the drawing assembly 13, the product 11 is subjected to a violent acceleration which takes its velocity to a value greater than the peripheral velocity of the outlet section of the tube 24. Because of this, the material tends to expand with respect to the nominal diameter of the coils 15 formed until that moment.

According to the invention, in the outlet zone of the coil-forming head 14, and in cooperation with the terminal section of the shaped tube 24, there is a ring-shaped containing element 29 arranged outside the shaped tube 24 and substantially coaxial therewith.

This containing element, or ring, 29 has one wall at least partly tapering and diverging towards the outside arranged in a position of cooperation with the outlet of the shaped tube 24.

In this case, the containing ring 29 has three consecutive segments, respectively a first substantially cylindrical segment 29*a* of a lesser diameter, a second segment 29*b* tapering and diverging towards the outside and a third substantially cylindrical segment 29*c* of a greater diameter.

The angle $\alpha$ defined by the tapering diverging segment 29*b* is advantageously but not restrictively between 10° and 80°, according to its longitudinal extension and its diameter, the diameter of the product 11 and the rolling speed.

In one embodiment of the invention, the containing ring 29 is solid with the bell element 28, and is therefore made to rotate by the rotary mandrel 18 of the coil-forming head 14.

According to a variant which is not shown here, the containing ring 29 is mounted fixed at the outlet of the coil-forming head 14.

Figure 4:
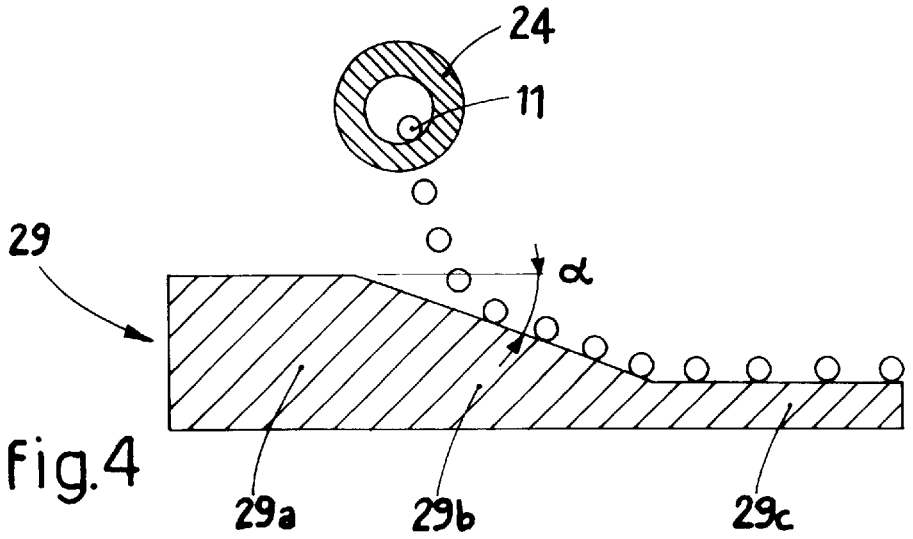
FIG. 4 shows schematically how the invention functions.

The trailing-end coil tends to expand radially due to the increased velocity acquired from the moment when the trailing end segment 11a leaves the drawing assembly 13; as it leaves the tube 24 it rests against the tapering inner wall of the segment 29*b* of the ring 29, following the trajectory indicated in FIG. 4.

In this way, the trailing end of the product can vent its excess kinetic energy, and yet remain confined in a controlled manner inside a contained volume and at the same time translate forwards, towards the outlet of the coil-forming head 14.

The substantially cylindrical terminal segment 29*c* has the function of stabilising the last coils formed before discharge.

The last coils obtained are of a slightly greater diameter than the nominal diameter, but in any case are well within an acceptable tolerance.

Moreover, no trailing-end loop is formed, since there is no violent, perpendicular impact of the trailing end 11*a* of the product against a cylindrical ring.

Nor is there any sliding of the front plate 25 against the product which has already been expelled from the tube, since the containing ring 29 encourages the translation of the coils 15 towards the outside of the coil-forming head 14 and towards the conveyor 16 for discharge.

Modifications and additions may be made to this invention, but these shall remain within the field and scope thereof.

To be more exact, the cylindrical segments 29*a*, 29*c* may not be included, the coil-forming head 14 may have different shape and drive means, the drawing assembly 13 may be replaced by another drawing element, the collection and stacking shaft 17 may be replaced by another accumulation device with the same function.

We claim:

1. A coil-forming head to form coils starting from continuous and substantially rectilinear rolled stock such as round pieces or rods, comprising a mandrel rotating around a substantially horizontal axis, driven by motor means, containing inside itself a shaped tube terminally conformed as a spiral inside which said rolled stock is introduced to be progressively curved until it is discharged in the form of coils from the outlet of said tube, wherein in cooperation with the terminal outlet section of said shaped tube there is a ring-shaped containing element arranged outside said shaped tube and including at least a segment of inner wall which tapers and diverges towards the outside suitable to allow a controlled expansion of the trailing-end segment of the rolled stock.

2. The coil-forming head as in claim 1, wherein the inclination of the tapering and outward diverging segment is between 10° and 80°.

3. The coil-forming head as in claim 2, wherein said containing ring is fixed.

4. The coil-forming head as in claim 2, wherein said containing ring is made to rotate together with the rotary mandrel.

5. The coil-forming head as in claim 1, wherein the containing element has a substantially cylindrical segment of a greater diameter located downstream of the tapering and outward diverging segment, with a function of stabilizing the trailing-end coils which have formed on said tapering and diverging segment.

6. The coil-forming head as in claim 5, wherein said containing ring is fixed.

7. The coil-forming head as in claim 5, wherein said containing ring is made to rotate together with the rotary mandrel.

8. The coil-forming head as in claim 1, wherein said containing ring has a substantially cylindrical segment of a lesser diameter located upstream of the tapering and outward diverging segment.

9. The coil-forming head as in claim 8, wherein said containing ring is fixed.

10. The coil-forming head as in claim 8, wherein said containing ring is made to rotate together with the rotary mandrel.

11. The coil-forming head as in claim 1, wherein said containing ring is fixed.

12. The coil-forming head as in claim 1, wherein said containing ring is made to rotate together with the rotary mandrel.

13. The coil-forming head as in claim 1, wherein said tube is supported at one end by a plate and at an intermediated position by a support element, said support element attached to said plate via a shaft.

14. The coil-forming head as in claim 1, wherein said motor means is adapted to peripherally rotate said mandrel at a velocity substantially equal to the linear velocity at which said stock is introduced.

15. A coil-forming head to form coils starting from continuous and substantially rectilinear rolled stock, comprising a mandrel rotating around a substantially horizontal axis, driven by motor means, containing inside itself a shaped tube terminally conformed as a spiral inside which said rolled stock is introduced to be progressively curved until it is discharged in the form of coils from the outlet of said tube; and a ring-shaped containing element arranged outside said shaped tube and including at least a segment of inner wall which tapers and diverges towards the outside suitable to allow a controlled expansion of the trailing-end segment of the rolled stock, and wherein said ring is positioned in cooperation with the terminal outlet section of said shaped tube, such that when said trailing end segment of said rolled stock diverges towards the outside, said trailing end segment abuts said tapered segment of said inner wall of said ring-shaped containing element to allow controlled expansion of the coils.

* * * * *